US005240449A

United States Patent [19]

Sloan et al.

[11] Patent Number: 5,240,449

[45] Date of Patent: * Aug. 31, 1993

[54] INFLATABLE BALLOON SYSTEM

[75] Inventors: John D. Sloan, Beach; Allan P. Newman, Arlington Heights; Stanley S. Budzinski, Addison, all of Ill.

[73] Assignee: Innovative Impressions, Inc., St. Charles, Ill.

[ * ] Notice: The portion of the term of this patent subsequent to Apr. 28, 2009 has been disclaimed.

[21] Appl. No.: 822,364

[22] Filed: Jan. 17, 1992

Related U.S. Application Data

[63] Continuation-in-part of Ser. No. 609,412, Nov. 5, 1990, Pat. No. 5,108,337.

[51] Int. Cl.[5] ..... A63H 3/06; A63H 33/30; B65D 83/00

[52] U.S. Cl. ..... 446/220; 446/473; 222/402.14

[58] Field of Search ..... 446/220, 224, 221, 222, 446/223, 225, 226, 267, 475, 483, 485; 222/402.14

[56] References Cited

U.S. PATENT DOCUMENTS

| | | | |
|---|---|---|---|
| 3,154,223 | 10/1963 | Messner | 222/402.14 |
| 3,174,455 | 4/1963 | Peterson | 446/220 X |
| 3,611,623 | 2/1970 | Copstead | 446/220 |
| 4,440,325 | 4/1984 | Treuhaft et al. | 222/402.14 |
| 4,586,456 | 5/1986 | Forward | 446/220 X |
| 4,857,029 | 9/1989 | Dierick et al. | 446/220 |
| 4,901,664 | 2/1990 | Labrecque | 446/220 |
| 4,902,958 | 2/1990 | Di Carlo et al. | 446/220 |
| 4,917,041 | 4/1990 | Weiswuram et al. | 446/224 X |
| 4,920,674 | 5/1990 | Shaeffer | 446/220 X |
| 5,277,004 | 7/1981 | Barlics | 222/402.14 |

*Primary Examiner*—Robert A. Hafer
*Assistant Examiner*—D. Neal Muir
*Attorney, Agent, or Firm*—Schiff Hardin & Waite

[57] ABSTRACT

An inflatable balloon system comprises an optional first container having an openable top and a collapsed balloon positioned within the first container. A compressed gas container having a gas release valve is provided, with the compressed gas container and release valve being sealed entirely within the collapsed balloon. The gas release valve faces the openable top. Upon opening of the top, one can actuate the gas release valve through the wall of the balloon, to release the compressed gas and to cause inflation of the balloon. The compressed gas container includes a quantity of water effective to prevent the gas from freezing ambient moisture upon expansion of the gas through the valve stem.

19 Claims, 1 Drawing Sheet

INFLATABLE BALLOON SYSTEM

This is a continuation in part of U.S. patent application Ser. No. 07/609,412, filed Nov. 5, 1990, now U.S. Pat. No. 5,108,337.

BACKGROUND OF THE INVENTION

This invention relates to an inflatable balloon system, which may be used as a toy or provided as a novelty gift item, a visual indicator, or the like.

Inflatable balloon systems are well known, being illustrated by DiCarlo et al. U.S. Pat. No. 4,903,958 and Copstead U.S. Pat. No. 3,611,623, for example.

In systems where a balloon is attached to a compressed gas container for later inflation, there is a technical problem of ensuring that the balloon does not prematurely detach from the container, particularly during the inflation process. And in other systems, after the balloon has been inflated, the outside compressed gas container remains as an encumbrance to the balloon, interfering with its full use in various aspects, for example as a decorative toy. If the user tries to disconnect the balloon from the container, once again the balloon may suddenly deflate. Also, apparatus that permits the separation of a balloon from its inflation container can be rather expensive and undesirable, and may fail in its function.

In accordance with this invention, an inflatable balloon system is provided in which the balloon may be readily separated from its package without any need for disconnecting a compressed gas container which is used to inflate the balloon, while the balloon may be packaged in a container. Upon actuation of the attached compressed gas container to release the gas into the balloon, the balloon may pop out of the container as a free-standing balloon, unconnected with any exterior connection.

DESCRIPTION OF THE INVENTION

In accordance with this invention, an inflatable balloon system comprises a first container having an openable top, although if desired the balloon may be provided free of such a first container. The balloon is typically initially in collapsed form, and is positioned within the first container when such a container is used. A compressed gas container is also provided, having a gas release valve. The compressed gas container and release valve are sealed entirely within the collapsed balloon. Typically, the gas release valve, when the balloon is in a first container, faces the openable top of the first container. Upon opening the top, one can actuate the gas release valve through the wall of the balloon to release the compressed gas and to cause inflation of the balloon.

The compressed gas container and release valve are thus located inside the balloon, which may be of spherical or other shape and completely sealed about the entire balloon periphery. The balloon itself may be a completely sealed structure, without any outward projections if desired, and with the emptied, compressed gas container serving as a ballast for the balloon. To inhibit the container from falling over, the container can be seated in a shallow well or recess located in the first container bottom.

Any desired gas may be used to inflate the balloon including compressed air, nitrogen, helium, carbon dioxide, or the like. Preferably, means are provided to retain the gas release valve in an actuated position once the valve is operated.

The compressed gas container typically has a valve stem as part of the gas release valve, and a valve cap carried on the compressed gas container engages the valve stem. Thus, pushing the valve cap actuates the valve stem. To retain the gas release valve in its actuated position once the valve is actuated, the container may have a curled, rearwardly-facing flange surrounding the valve stem, as is well known. The valve cap has hooked, snap-fit arms that engage the flange when the valve cap is pushed into position to actuate the valve stem. Thus the valve cap and valve stem are retained in their valve-actuated positions.

In addition, the compressed gas container includes a quantity of water that is effective to aid in propelling the gas from the compressed gas container by keeping the gas from freezing ambient moisture that would block the valve stem.

Accordingly, an inflatable balloon system is provided, which may be independent of any balloon container or box, although it may also be used with and in such a container. A balloon with an uninterrupted outer wall may be provided, free of any outward projections such as an inflation port or the like, since the balloon is completely sealed with the inflation means carried within it. Such a balloon can have better-than ordinary gas-holding characteristics, since there is no inflation port in the balloon through which leakage can take place. Finally, the balloon and contained inflation means are supported by an insert for stabilizing the inflation means within the container.

DESCRIPTION OF SPECIFIC EMBODIMENTS

Figure 1:
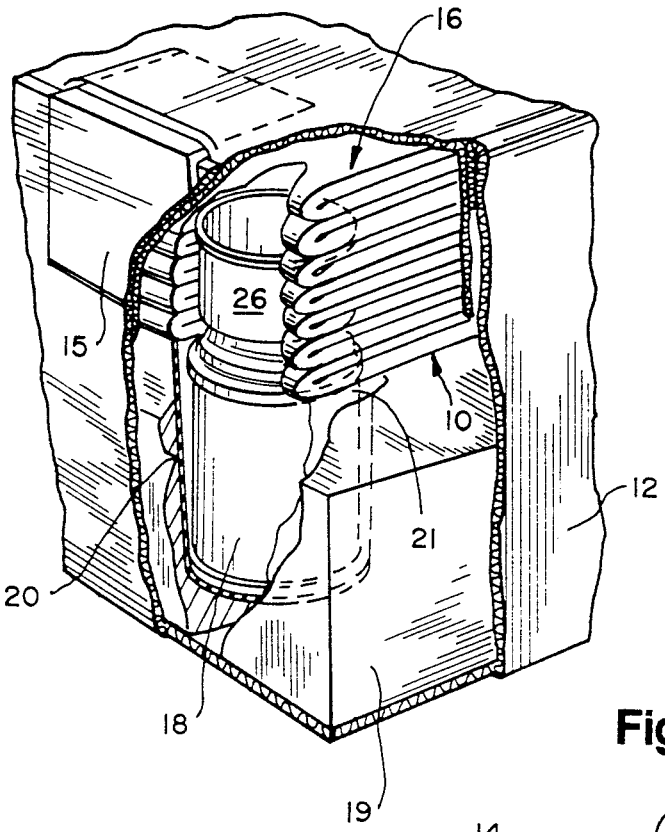
FIG. 1 is a fragmentary, perspective view, with portions broken away, of the inflatable balloon system of this invention positioned within a box.
Figure 2:
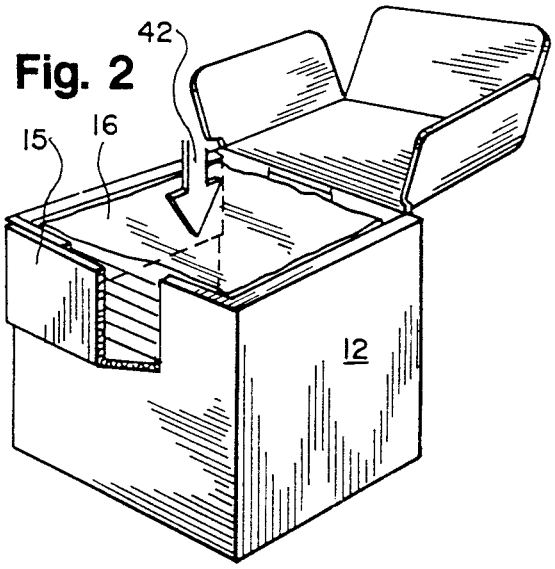
FIG. 2 is a complete perspective view showing the box of FIG. 1 in opened condition.

Referring to FIGS. 1 and 2, an inflatable balloon system 10 is disclosed, being carried in a standard cardboard box 12. Box 12 defines an openable lid 14. When the lid 14 is opened, a sleeve 15 is exposed. Under sleeve 15 is a balloon 16, which is in a folded array. Also, balloon system 10 includes a compressed gas container 18, which may be of conventional design, located entirely within the collapsed balloon 16. Preferably, some portion of compressed gas container 18 is sealed to the wall 20 of balloon 16. To encourage gas container 18 to remain upright in box 12, the container 18 is supported by an insert 19 that fits snugly into the lower portion of box 12. Insert 19, which may be made of foam or another, similar material, includes well 21 which is proportioned to accept container 18 and to support the container in an upright position.

Figure 4:
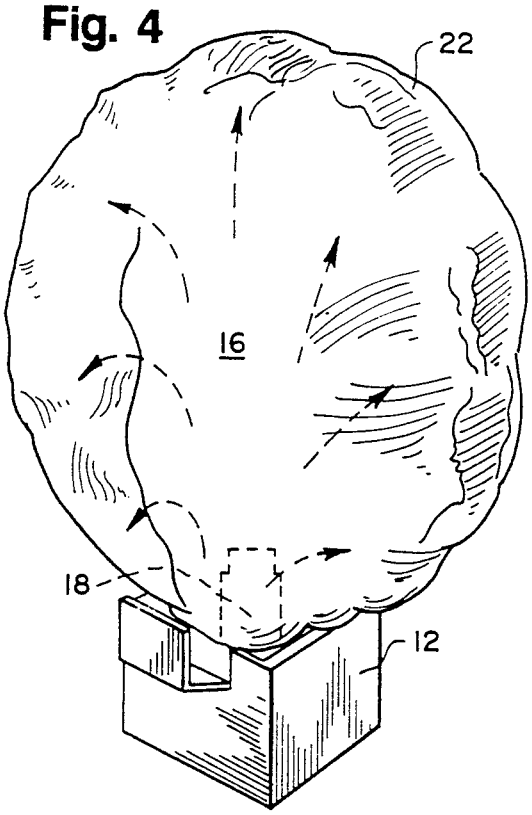
FIG. 4 is a perspective view showing the inflated balloon inflating out of its box, in free, unconnected relation thereto.

Balloon 16 may be completely sealed, so that it may be inflated without an inflation port. Typically, this sealing may take place along a peripheral sealing line 22, (FIG. 4) with the balloon comprising, for example, a pair of circular sheets sealed together at seal line 22. However, other designs for balloon 16 and other methods of sealing may be used as well.

Figure 3:
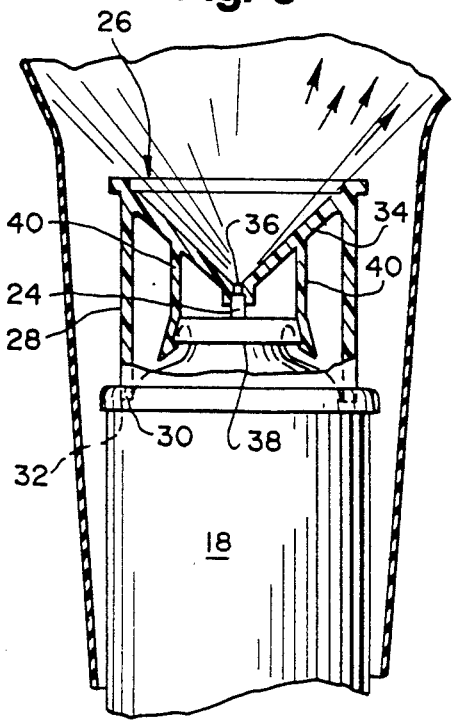
FIG. 3 is a fragmentary sectional view showing how the compressed gas container, having its valve cap depressed, is locked to hold the valve stem in valve-open position to inflate the balloon.

As particularly shown in FIG. 3, compressed gas container 18 may define a valve stem 24. This valve and stem, and the compressed gas container 18, all may be of generally conventional design.

A plastic valve cap 26 rests on container 18. Cap 26 has an outer cylindrical portion 28 with a lower annular edge 30 that can be wedged into annular recess 32 of container 18, so as to preliminarily retain the cap 26 in a ready position.

Valve cap 28 also includes an inner, conical portion 34 which engages valve stem 24 and defines an aperture 36. This aperture permits release of compressed gas through valve stem 24, when valve stem 24 is depressed by cap 28. Also, as shown particularly in FIG. 3, compressed gas container 18 defines a curled, rearwardly facing flange 38 of conventional design surrounding valve stem 24. Valve cap 26 defines hooked, snap-fit arms 40 that engage flange 38 when the valve cap 26 is pushed into position to actuate valve stem 24. Thus, valve cap 26 is retained in its valve-actuating position, once it is pushed into such position for the first time, by snap-fit arms 40 so that the pressurized contents of container 18 can completely be expelled to inflate the surrounding balloon.

Compressed gas container 18 also includes a quantity of water that is effective to prevent freezing of ambient moisture by the compressed gas as it exits the valve stem and expands, thereby preventing or delaying inflation of the balloon. Preferably, the quantity of water employed is approximately 100–150 percent (by weight) of the quantity of compressed gas employed. Thus, in one embodiment, 50 g of compressed gas are employed to inflate the balloon, and 50–75 g of water are employed to prevent freezing. The specific quantity of water employed will be dependent upon the identity of the compressed gas employed and the temperature drop on expansion through the valve stem.

The inflatable balloon system 10 may be packed in a carton 12 as shown in FIGS. 1 and 2. Upon opening of the top of carton 12, a sleeve 15 is exposed. If desired, sleeve 15 may bear a legend such as "STOP. PRESS HARD HERE AND THEN RELEASE." When the user presses downwardly on the sleeve 15 and folded balloon 16 as illustrated by arrow 42 in FIG. 2, valve cap 26 is pushed down into the valve-open, gas-discharge configuration shown in FIG. 3. The depressed valve stem 24 then inflates balloon 16 as particularly shown in FIG. 4, so that balloon 16 comes free of box 12, and sloughs off sleeve 15. All that is required for balloon inflation is to press downwardly on cap 26 through sleeve 15 and balloon 16, and the balloon 16 spontaneously inflates.

The above is offered for illustrative purposes only, and is not intended to limit the scope of the invention of this application, which is defined by the claims below.

What is claimed is:

1. An inflatable balloon system, which comprises:

a first container having an openable top;

a collapsed balloon positioned within said first container;

a compressed gas container having a gas release valve, said compressed gas container and release valve being sealed entirely within said collapsed balloon, said gas release valve facing said openable box top whereby, upon opening of the top, one can actuate said gas release valve through the wall of the balloon to release said compressed gas and thereby cause inflation of said balloon, said compressed gas container including a quantity of water effective to prevent valve failure due to freezing.

2. The inflatable balloon system of claim 1 in which holding means are provided to retain said gas release valve in a gas-delivering actuated position once the valve is actuated.

3. The inflatable balloon system of claim 1 in which said gas container defines a valve stem as said gas release valve, and a valve cap carried on said container and engaging said valve stem, whereby pushing of said valve cap actuates said valve.

4. The inflatable balloon system of claim 1 including a sleeve member between said openable top and said balloon.

5. The inflatable balloon system of claim 1, wherein the quantity of water employed is 100–150 percent by weight of the quantity of compressed gas employed.

6. The inflatable balloon system of claim 1 including means for supporting the compressed gas container within the first container.

7. The inflatable balloon system of claim 6, wherein said means for supporting the compressed gas container comprises a foam insert fitting snugly within the first container, including a well for receiving the compressed gas container.

8. An inflatable balloon system, which comprises:

a first container having an openable top;

a collapsed balloon positioned within said first container;

a compressed gas container having a gas release valve, said compressed gas container and release valve being sealed entirely within said collapsed balloon, said gas release valve facing said openable top whereby, upon opening of the top, one can actuate said gas release valve through the wall of the balloon to release compressed gas and to cause inflation of said balloon; and holding means provided to retain said gas release valve in actuated position once the valve is actuated, in which said gas container defines a valve stem as part of said gas release valve, and a valve cap carried on said container and engaging said valve stem, whereby pushing of said valve cap actuates said valve stem, said compressed gas container including a quantity of water effective to prevent valve failure due to freezing.

9. The inflatable balloon system of claim 8 including a sleeve member between said openable top and said balloon.

10. The inflatable balloon system of claim 9 in which said container defines a curled, rearwardly-facing flange surrounding said valve stem, said valve cap defining snap-fit means that engage said flange when the valve cap is pushed into position to actuate said valve stem, whereby said valve cap is retained in the valve-actuated, gas-releasing position.

11. The inflatable balloon system of claim 8, wherein the quantity of water employed is 100–150 percent by weight of the quantity of compressed gas employed.

12. The inflatable balloon system of claim 8 including means for supporting the compressed gas container within the first container.

13. The inflatable balloon system of claim 12, wherein said means for supporting the compressed gas container comprises a foam insert fitting snugly within the first container, including a well for receiving the compressed gas container.

14. An inflatable balloon system, which comprises:

a collapsed balloon;

a compressed fluid container having a fluid release valve, said compressed fluid container and release valve being sealed entirely within said collapsed balloon, whereby one can actuate said fluid release valve through the wall of the balloon to release said compressed fluid and to cause inflation of said balloon, said compressed gas container including a quantity of water effective to prevent valve failure due to freezing.

15. The inflatable balloon system of claim 14 in which holding means are provided to retain said fluid release valve in an actuated position once the valve is actuated.

16. The inflatable balloon system of claim 14 in which said compressed fluid container defines a valve stem as part of said fluid release valve, and a valve cap carried on said container and engaging said valve stem, whereby pushing of said valve cap actuates said valve stem.

17. The inflatable balloon system of claim 16 in which holding means are provided to retain said fluid release valve in actuated position once the valve is actuated.

18. The inflatable balloon system of claim 14 in which said compressed fluid container defines a curled, rearwardly-facing flange surrounding said valve stem, said valve cap defining hooked, snap-fit arms that engage said flange when the valve cap is pushed into position to actuate said valve stem, whereby said valve cap is retained in said valve-actuating position.

19. The inflatable balloon system of claim 8, wherein the quantity of water employed is 100–150 percent by weight of the quantity of compressed gas employed.

* * * * *